US011473284B2

(12) United States Patent
Schomburg et al.

(10) Patent No.: US 11,473,284 B2
(45) **Date of Patent: *Oct. 18, 2022**

(54) INTELLIGENT, DATA GATHERING AND COMMUNICATING PORTABLE RESTROOMS

(71) Applicant: SATELLITE INDUSTRIES, INC., Minneapolis, MN (US)

(72) Inventors: Kenneth V. Schomburg, Plymouth, MN (US); Ronald J. Holmstadt, Carver, MN (US)

(73) Assignee: Satellite Industries, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/087,184

(22) Filed: Nov. 2, 2020

(65) Prior Publication Data

US 2021/0047818 A1 Feb. 18, 2021

Related U.S. Application Data

(63) Continuation of application No. 16/120,301, filed on Sep. 2, 2018, now Pat. No. 10,822,784, which is a continuation of application No. 15/242,393, filed on Aug. 19, 2016, now Pat. No. 10,066,379.

(60) Provisional application No. 62/207,131, filed on Aug. 19, 2015.

(51) Int. Cl.
*E03D 7/00* (2006.01)
*E04H 1/12* (2006.01)
(Continued)

(52) U.S. Cl.
CPC ..... *E03D 7/00* (2013.01); *A47K 5/1217* (2013.01); *A47K 10/18* (2013.01); *E03D 5/105* (2013.01);
(Continued)

(58) Field of Classification Search
CPC .. E03D 7/00; E03D 5/105; E03D 9/04; E03D 9/12; E03D 1/1216; A47K 5/1217; A47K 10/18; E04H 1/1216
(Continued)

(56) References Cited

U.S. PATENT DOCUMENTS 6,615,414 B2 * 9/2003 Miller ..... E03D 7/00 4/321
9,340,963 B2 * 5/2016 Ito ..... E04H 1/1266
(Continued)

*Primary Examiner* — Huyen D Le
(74) *Attorney, Agent, or Firm* — Skaar Ulbrich Macari, P.A.

(57) ABSTRACT

A portable restroom includes an enclosed interior including a door, a waste tank, a commode disposed within the enclosed interior and coupled to the waste tank, a power source, a microprocessor coupled to the power source, a door sensor positioned to sense whether the door is open or closed, and a door lock sensor positioned to sense whether the door is locked or unlocked. Sensors can be provided to sense the closed status of the door and the status of the door lock. Additional sensors can monitor various levels and usage of consumables. The microprocessor monitors the sensed data and wirelessly alerts a service provider when the restroom needs service. A payment receiving means can be provided to the portable restroom and coupled to the microprocessor so that a user can provide payment for access to the portable restroom.

20 Claims, 18 Drawing Sheets

(51) Int. Cl.

| | |
|---|---|
| ***E03D 5/10*** | (2006.01) |
| ***E03D 9/04*** | (2006.01) |
| ***E03D 9/12*** | (2006.01) |
| ***A47K 5/12*** | (2006.01) |
| ***A47K 10/18*** | (2006.01) |

(52) U.S. Cl.
CPC ..... *E03D 9/04* (2013.01); *E03D 9/12* (2013.01); *E04H 1/1216* (2013.01)

(58) Field of Classification Search
USPC ..... 4/664
See application file for complete search history.

(56) References Cited

U.S. PATENT DOCUMENTS

| | | | | |
|---|---|---|---|---|
| 10,066,379 | B2 * | 9/2018 | Schomburg | A47K 10/18 |
| 10,822,784 | B2 * | 11/2020 | Schomburg | A47K 5/1217 |
| 2003/0210140 | A1 * | 11/2003 | Menard | E03D 7/00 340/531 |
| 2006/0277675 | A1 * | 12/2006 | Tinnell | F04D 25/0606 4/477 |
| 2008/0127411 | A1 * | 6/2008 | Hoffjann | B60R 15/04 4/664 |
| 2013/0167293 | A1 * | 7/2013 | Nakaya | E04H 1/1216 4/321 |
| 2014/0090165 | A1 * | 4/2014 | Phillips | A47K 3/28 4/597 |

* cited by examiner

INTELLIGENT, DATA GATHERING AND COMMUNICATING PORTABLE RESTROOMS

PRIORITY

This application is a continuation of U.S. patent application Ser. No. 16/120,301, filed Sep. 2, 2018, which is a continuation of U.S. patent application Ser. No. 15/242,393, filed Aug. 19, 2016, now U.S. Pat. No. 10,066,379, which claims the priority benefit of U.S. Provisional Application No. 62/207,131, filed on Aug. 19, 2015. All of the foregoing applications are hereby incorporated herein by reference in their entirety.

FIELD

The present invention relates generally to portable restroom, and more particularly to portable restrooms with intelligent touchless features, data gathering and communication capabilities.

BACKGROUND

Portable restrooms are normally serviced by the company that rents them out to event organizers. The rental contract includes an agreed-upon schedule for service of the units, which may be as seldom as once per month or as often as once per day. The frequency of service is based on the estimated number of per day uses of the restrooms at that particular site. Servicing of the restroom includes vacuuming out the waste, putting a charge of clean water and deodorizer back into the tank(s), replenishing consumables such as toilet paper and hand sanitizer, washing down the interior of the restroom, and inspecting the unit for any damage or malfunction.

It can be very difficult to correctly estimate the number of uses a given restroom might see during an event. Just the physical placement of a restroom in relation to any neighboring restrooms can make a big difference in the number of uses it sees. One restroom may get used 50 times per day, while another restroom at the same event may only get used 5 times per day, but the rental contract states that they all get serviced with the same frequency. This often causes some restrooms to get dirty or full sooner than others. A dirty or full portable restroom creates an extremely unsanitary condition for the user, and an undesirable image towards both the rental company and portable restrooms in general.

Other problems with conventional portable restrooms include odor, heat and visibility of the waste in the tank. For example, the majority of conventional portable restrooms in the U.S. employ what is called a "straight drop" tank, in which the user essentially sits over a large opening in the tank. This allows the user to see all of the waste that has accumulated in the toilet and for odors to travel directly to the user. This is one of the worst aspects of using a standard portable restroom.

Thus, there is a need for improved portable restrooms that address one or more of the above-mentioned drawbacks.

SUMMARY

The present invention provides an improved restroom that addresses some or all of the deficiencies noted above. In one aspect, the invention is a portable restroom that helps to prevent the occurrence of a dirty portable restroom, greatly increases the comfort of the user, promotes good hygiene, and provides critical data gathering capabilities for the portable restroom service operator.

Incorporating electrical power and wireless communication into the restroom allows the individual restroom to notify the service provider of the need for service or of an emergency situation.

An automatic flushing feature, as well as the touchless flushing feature, helps to keep the restroom clean and reduce the number of surfaces that the user needs to touch while using the restroom.

An automatic light provides welcome lighting in darker locations.

An electric fan increases ventilation and reduces odor and temperature in the restroom.

Automated data gathering allows the service provider to measure the number of uses each restroom sees and can therefore adjust the frequency of service or number and location of restrooms placed at future events.

The disclosure includes an improved portable restroom with electrical power and communications features. The restroom includes an automatic flushing feature, as well as a touchless flush request sensor. An automatic light provides welcome lighting in darker locations. An electric fan increases ventilation and reduces odor and temperature in the restroom. Sensors monitor various levels and usage. A controller monitors the sensed data and wirelessly alerts a service provider that the restroom needs service. A flushing bowl is placed in the large tank opening to hide the waste within the tank. The flushing bowl includes a relatively small opening in a forward portion of the inner bowl surface for waste to pass through. A spray nozzle for directing water over the interior of the bowl is provided to minimize the chance that waste sticks to the inner bowl.

The disclosure also includes a portable restroom comprising a plurality of walls, a door in a door frame joined with the walls, and a roof disposed atop the walls and door frame. A base provided to the plurality of walls and door frame defines a floor of the portable restroom. The plurality of walls, the door in the door frame, the roof and the base together define an enclosed interior space. The base defines a waste tank, a control electronics compartment and a fresh water tank therein. A commode is disposed above the waste tank. A power source is disposed within the control electronics compartment. A microprocessor is disposed within the control electronics compartment and coupled to the power source. A memory is coupled to the microprocessor. A waste level sensor is disposed in the waste tank and coupled to the microprocessor. A fresh water level sensor is disposed in the fresh water tank and coupled to the microprocessor. A door sensor is positioned to sense whether the door is open or closed and is coupled to the microprocessor. A door lock sensor is positioned to sense whether the door is locked or unlocked, and is coupled to the microprocessor. A light is disposed within the enclosed interior space and coupled to the microprocessor. An electric pump is coupled to the microprocessor and operably coupled to the fresh water tank and to the commode.

The disclosure also includes a method of operating a portable restroom. The method can include monitoring a door sensor to determine whether a door of the portable restroom is open, monitoring a door lock sensor to determine whether the door of the portable restroom is locked within a set window of time beginning with a door opening event, turning on a light in the portable restroom automatically when the door is opened, turning an exhaust fan on automatically when the door is opened, turning on an electric pump automatically to create a continuous flow of water through a bowl of a commode upon determining that the door has been opened and then locked within the set window of time, and adjusting a speed setting of the electric pump to temporally increase a flow rate of the water through a bowl of a commode upon a user actuating a touchless flush request sensor.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
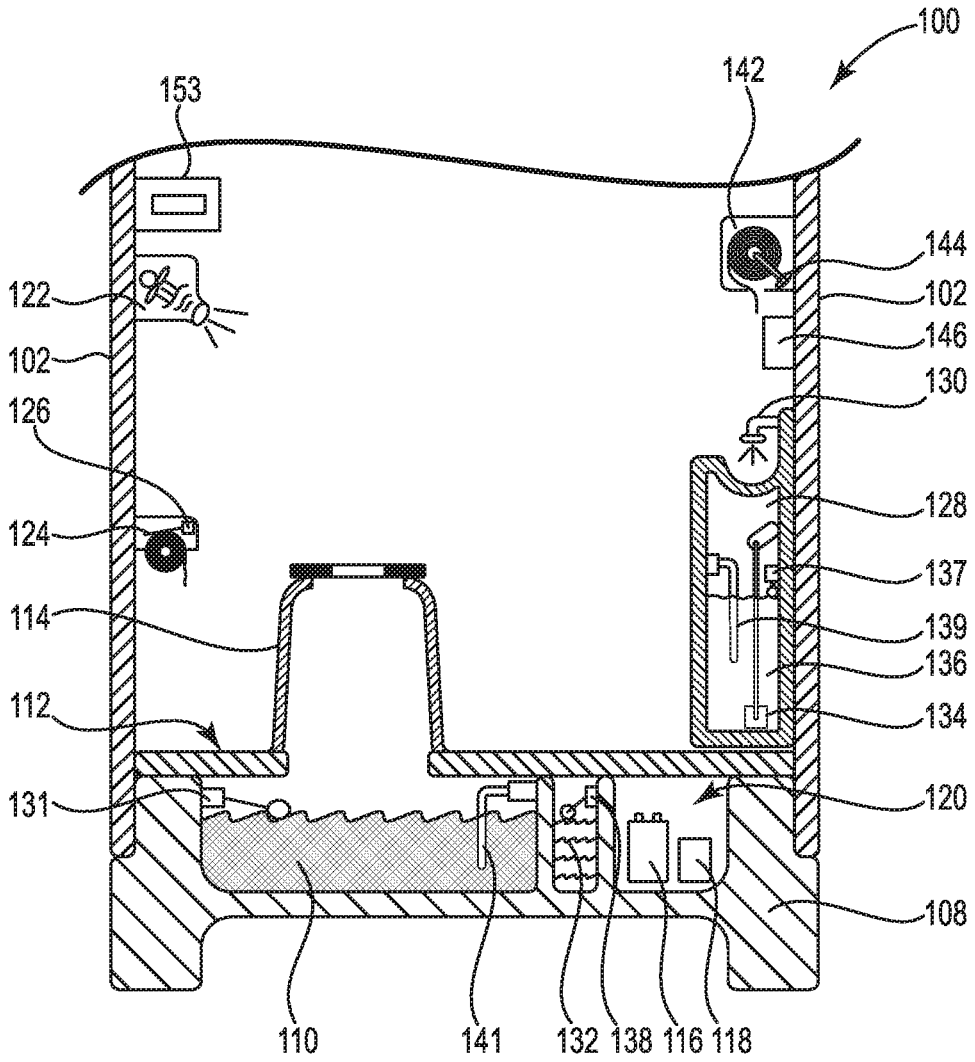
FIG. 1 is a side cross sectional view of a portion of an intelligent portable restroom according to certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

The features and aspects of the present invention can be adapted to a wide variety of portable restroom configurations, including for example, the portable restroom disclosed in U.S. Pat. No. 7,975,325, entitled PORTABLE TOILET. U.S. Pat. No. 7,975,325 is hereby incorporated by reference herein in its entirety. Other portable restroom configurations and proportions can be provided without departing from the scope of the invention, unless explicitly indicated in a particular claim.

Figure 19:
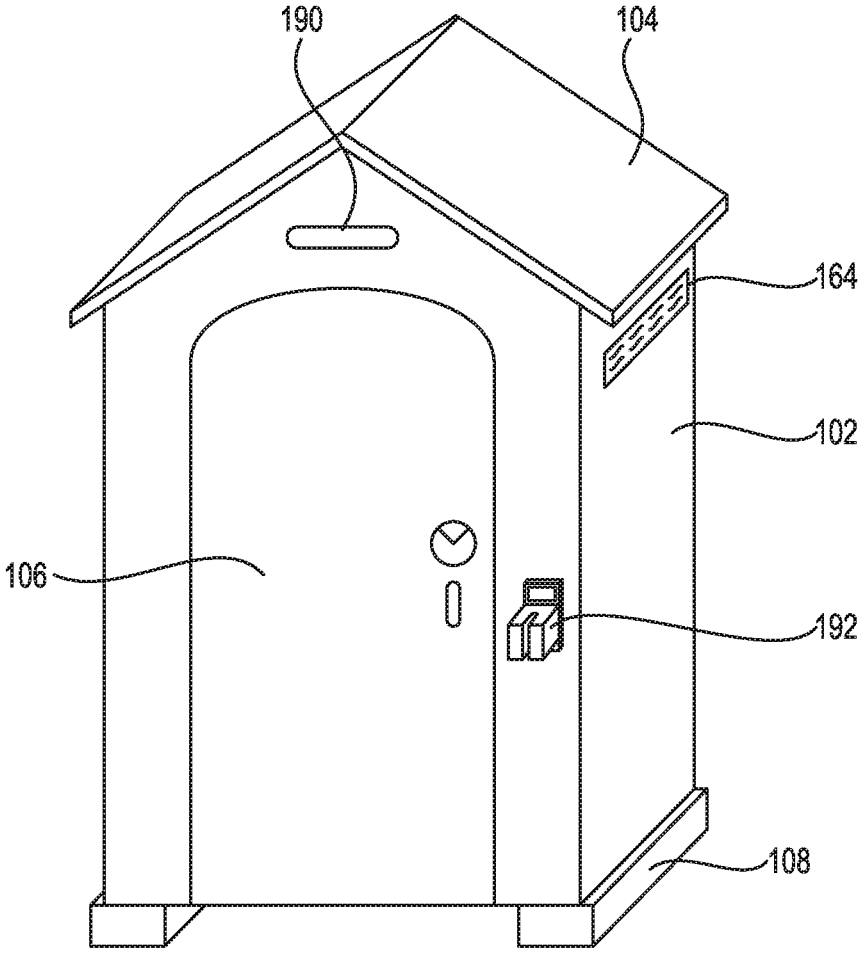
FIG. 19 is an exterior view of an intelligent portable restroom according to certain example embodiments.

Referring to FIGS. 1 and 19 specifically, and FIGS. 2-18 generally, a portable restroom 100 according to certain embodiments is generally made of polyethylene (or other plastic) sheet products for the walls 102 and roof 104. The door 106 and door frame are made of sheet products or twin-sheet thermoformed, or blow-molded, or injection molded components. The base 108 is a hollow plastic piece made by rotational or blow molding. The base 108 incorporates a waste tank 110. The floor 112 of the restroom creates the top of the waste tank 110. The commode 114 protrudes from the floor 112 to a height appropriate for use by people in a sitting position. Additional features and accessories of certain example embodiments will now be discussed with reference to specific figures.

As shown in FIG. 1, a battery 116 is stored along side the control electronics 118 in a compartment 120 defined in the base 108. The compartment 120 is located under the floor 112 and separated from the waste tank 110. Such location prevents vandal access to the battery 116 and control electronics 118. This compartment 120 location also permits the exterior appearance of the portable restroom 100 to be the same as a conventional portable restroom.

Figure 14:
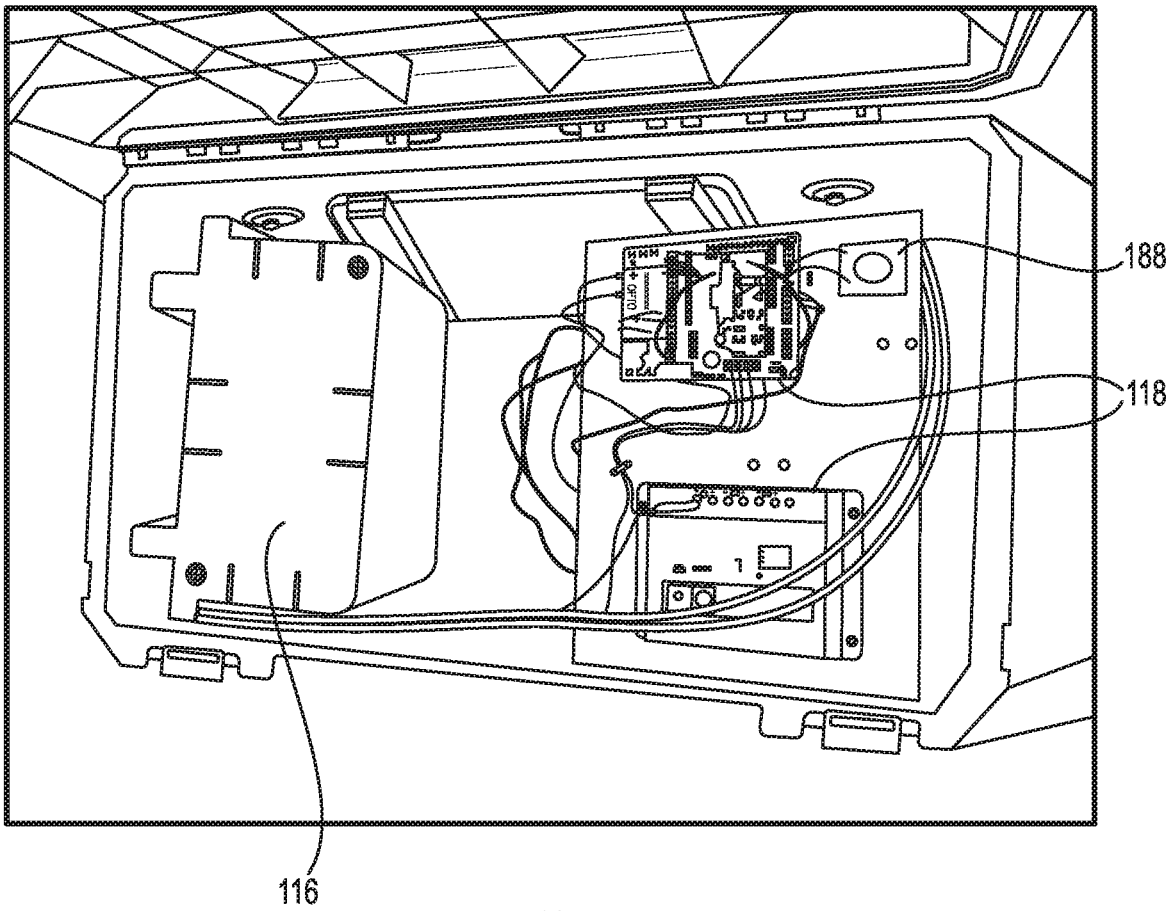
FIG. 14 is a detail view of a portion of an intelligent portable restroom according to certain example embodiments.

The control electronics 118 includes a microprocessor (also referred to as a controller or processor) and nontransitory memory. The control electronics 118 are shown in FIG. 14, and will be discussed in greater detail herein below.

Figure 2:
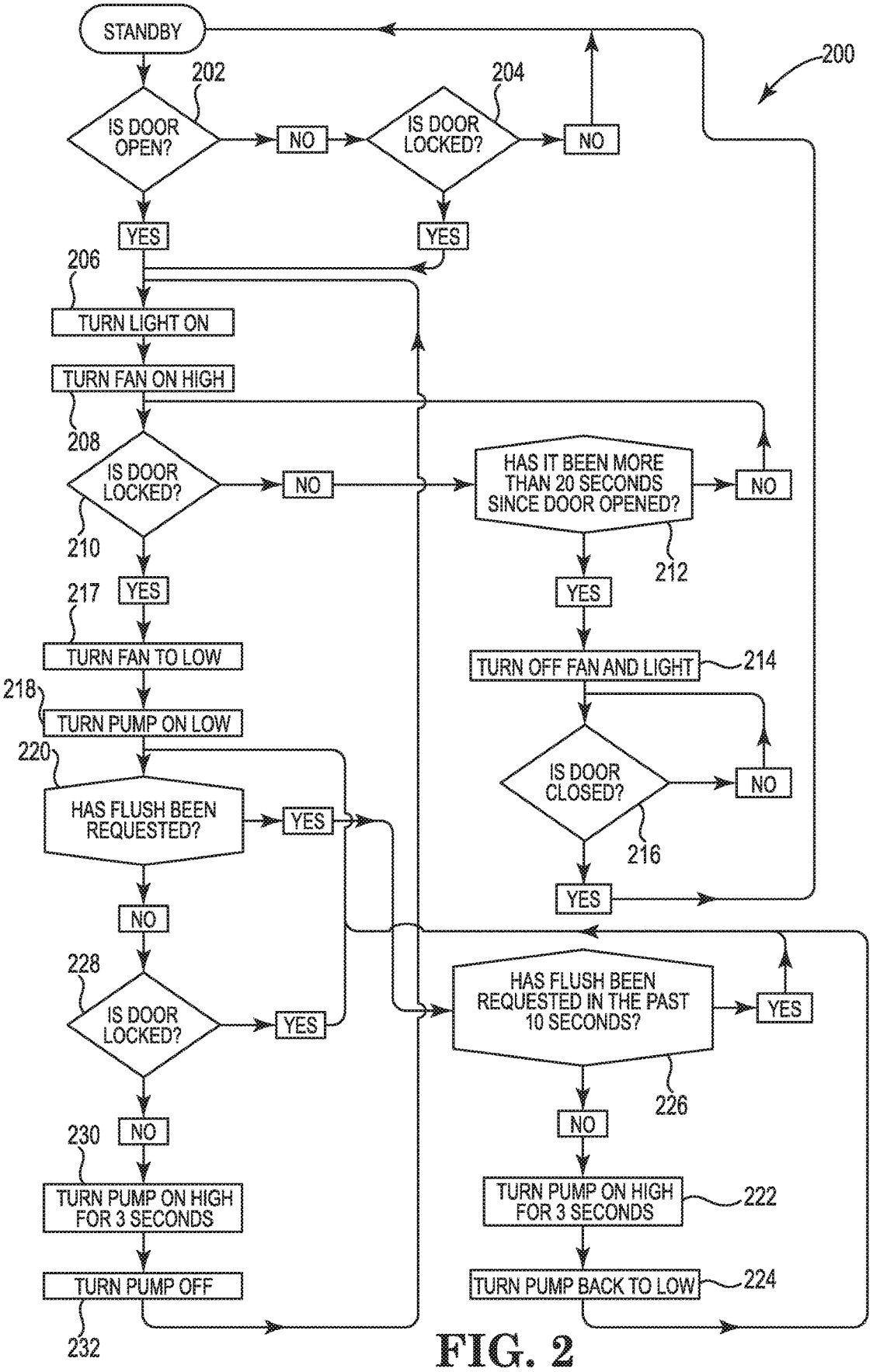
FIG. 2 is a logic diagram for an intelligent portable restroom according to certain example embodiments.

Software code is stored in the memory and executed by the processor such that the processor selectively operates certain features of the portable restroom as disclosed herein. FIG. 2 illustrates example operating logic for the software code of the portable restroom. This logic can be reduced to software code in any suitable coding language. Information collected by the processor by various sensors can be stored in memory and/or transmitted wirelessly to a remote location. The processor, software code and various sensors throughout the restroom allow the restroom to operate with a high level of intelligence.

Referring to FIG. 2, certain operational logic 200 of the restroom 100 is shown. The processor monitors a door sensor to determine whether the door has been opened 202. The restroom remains in standby status while the door remains closed and unlocked 204. When the door is opened and locked 204, then it is assumed that a person might begin using the restroom. If the door is not locked 204 following an opening, then the restroom returns to standby status.

Upon determining that the door was opened 202, the processor turns on the lights 206 and fan 208 inside the restroom. The door lock is continually monitored 210 for a period of time (e.g. 20 seconds) 212. If the door remains unlocked following the monitoring period 212, then the fan and light are turned off 214 and the restroom returns to standby if the door is closed 216.

If the door is locked within the monitoring period 212, then the fan is turned to a low setting 217 and the water pump is turned on to a low setting 218. The low setting is maintained to ensure that the bowl of the commode remains free of waste.

The flush request sensor is monitored 220 to determine whether the user has requested a flush. If yes, then the water pump is turned to high for three seconds 222 to "flush" the commode. Afterwards, the pump returns to the low setting 224. Repeated requests for flushing by the user occurring within a set time window (e.g. ten seconds) are ignored 226. Once the door is unlocked 228, then an automatic final "flush" is performed by turning the pump to the high setting 230 for three seconds, and then off 232.

The operating logic described above provides certain benefits. For example, upon opening the door just slightly, the light is turned on and the fan is turned on to high power in an effort to evacuate any odor and hot air from the restroom. If the door is not locked within a set period of time, the light and fan are turned off to conserve power and the processor waits for the door to be opened again.

Figure 3:
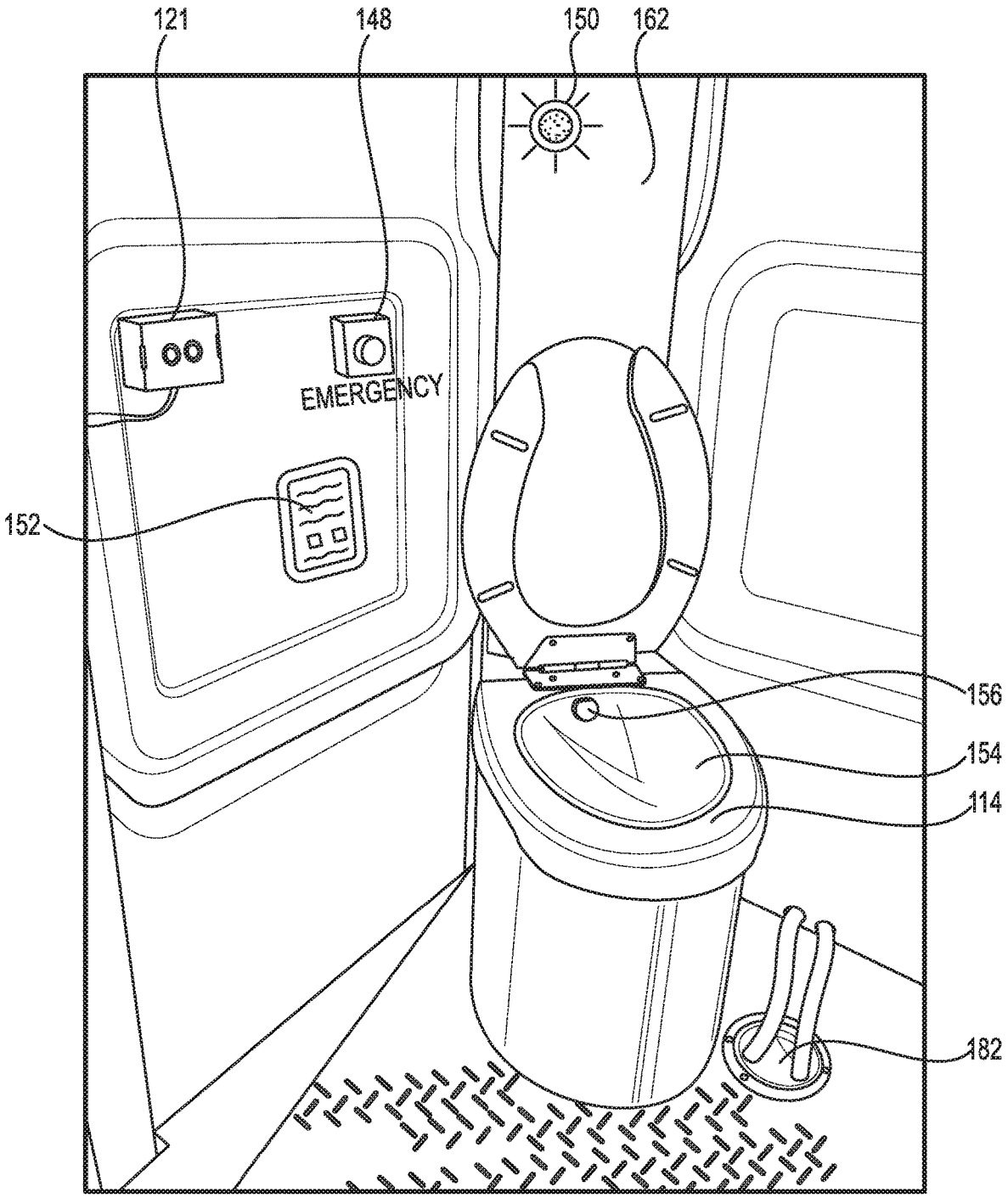
FIG. 3 is a detail view of a portion of an intelligent portable restroom according to certain example embodiments.
Figure 12:
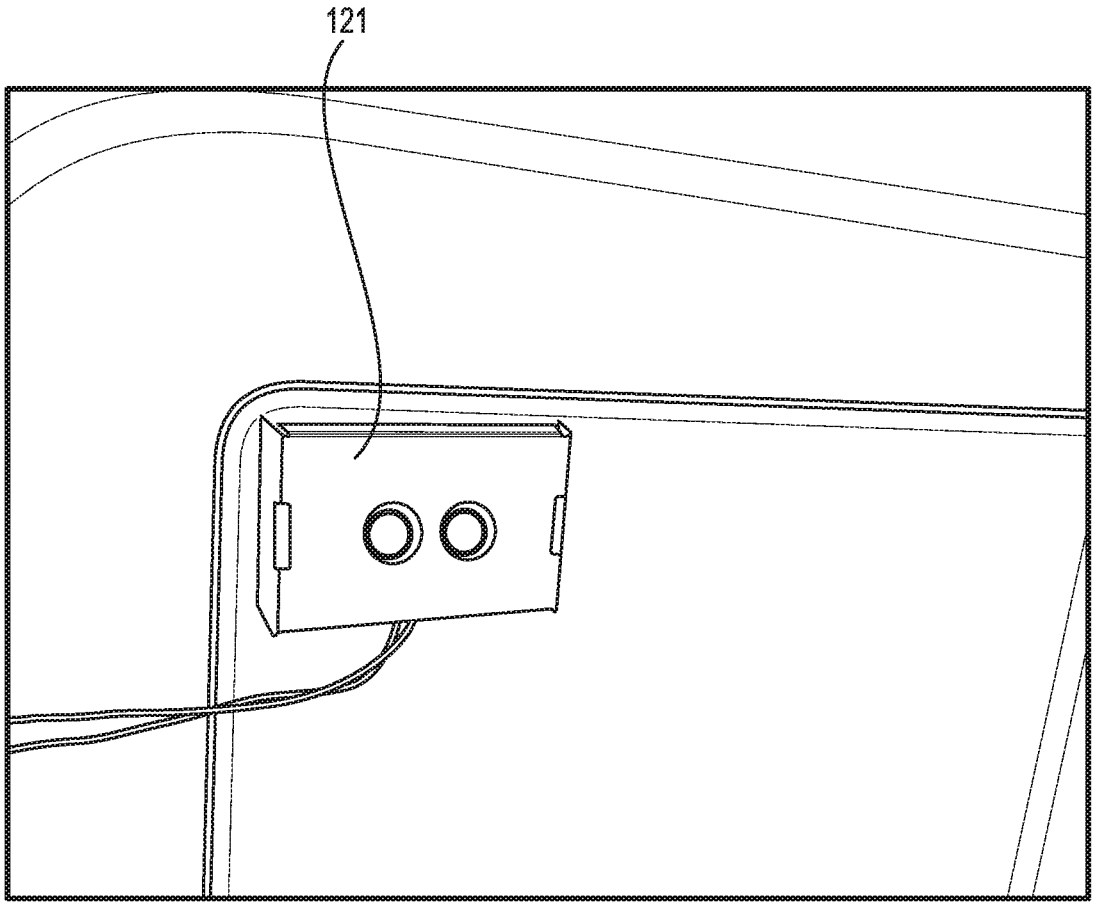
FIG. 12 is a detail view of a portion of an intelligent portable restroom according to certain example embodiments.

Once the door is locked, the fan is turned to a lower level so that noise is reduced during use. At the same time, the water pump is turned on low to provide a light flow of water over and through the toilet (commode) bowl. This light flow of water while the toilet is being used aids in keeping the toilet bowl cleaner and more free of streaking. At any time the user can request a flush by passing his hand past the touchless flush request sensor 121, mounted on the wall near the toilet as shown in FIGS. 3 and 12. If a request for a flush occurs within a set period of time (e.g. 10 seconds) of a previous flush, the controller does not flush in order to conserve battery power.

Once the restroom door is unlocked, a full power flush is automatically initiated by the controller. This feature alleviates the user from having to request a flush at all, and discards any waste if a user forgot to request a flush. After this last flush, the water pump is turned off. The fan is turned on to full power for a few seconds to evacuate any odors for the next user. The light remains on with the fan. After this period, the fan and light are turned off and the controller waits for the door to open again.

Referring again to FIG. 1, several additional aspects of certain embodiments will now be described. A hand dryer 122 can be provided to blow warmed air towards the user for drying hands. The dryer can be actuated by a proximity sensor and/or a manual actuator (e.g. button). The air flow can be warmed with heating elements in the air stream, or simply be air taken in through an inlet located inside or outside of the restroom.

A toilet paper roll 124 is disposed adjacent the commode. A sensor 126 can be provided in the toilet paper dispenser and coupled to the processor so that the processor can monitor remaining paper volume and call for replenishment when needed.

A hand wash station 128 can be disposed inside of the restroom. The hand wash station 128 includes a water faucet 130 for the user to wash their hands. A fresh water tank, container or compartment 136 can be formed within the base of the hand wash station 128 to hold water for washing hands. Water from the fresh water tank 136 can be pumped via a pump 134 disposed in the fresh tank and to the faucet 130. Water is pumped to the faucet 130 to flow out of the faucet 130 when the user's hands are sensed by a proximity sensor disposed in the faucet.

Spent or "grey" water from the hand wash station can flow by gravity through passages to collect in the waste tank 110. A waste water level sensor 131 can be disposed within the waste tank 110 and coupled to the processor to allow for level monitoring and call for service when needed. Likewise, a hand wash fresh water level sensor 137 can be disposed inside of the fresh water tank 136 and monitored by the processor for service needs.

The water in the hand wash fresh water tank 136 can be heated via heater 139 so that it does not freeze when the outside environment is below the freezing point. The fresh water can also be kept elevated above ambient temperature for the comfort of the user when washing hands via a heater element 139. A heater 141 can also be disposed within the waste tank 110 to prevent freezing. Likewise, a heater element can be disposed within the fresh water flush tank 132 that is defined in the base 108. Corresponding temperature sensors are disposed in each tank and coupled to the processor for monitoring. The processor is also coupled to the respective heating elements to selectively operate the elements to maintain the desired temperature settings.

The hand wash station can also be disposed on the outside of the restroom or adjacent to the restroom. The fresh water tank 136 can also reside within the base 108 instead of within the hand wash station 128.

A waste water level sensor 131 can be disposed within the waste tank 110 and coupled to the processor to allow for level monitoring and call for service when needed.

A hand towel dispenser 142 can also be provided within the restroom for the user to dry their hands. Again, a paper sensor 144 can be disposed within the towel dispenser and coupled to the processor to allow for usage monitoring and call for service when needed.

Figure 13A:
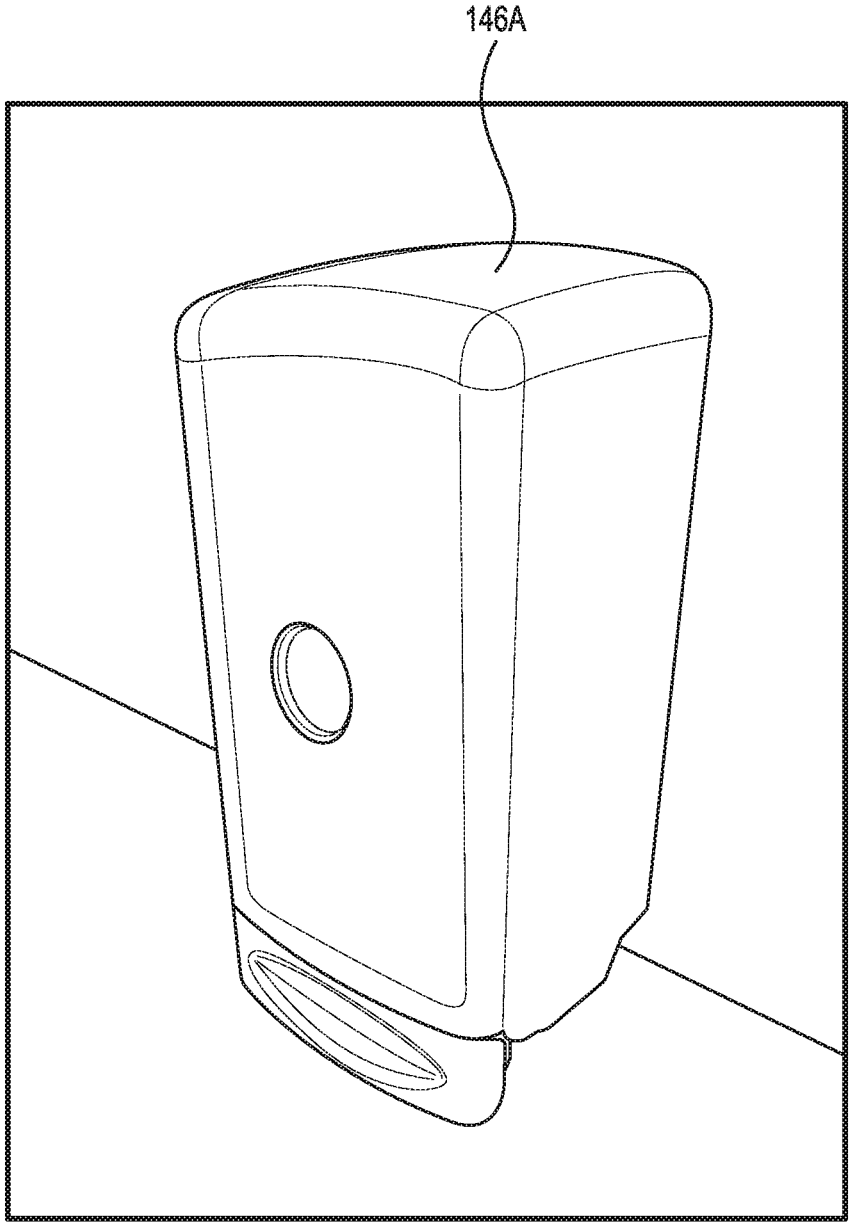
FIG. 13A is a detail view of a portion of an intelligent portable restroom according to certain example embodiments.
Figure 13B:
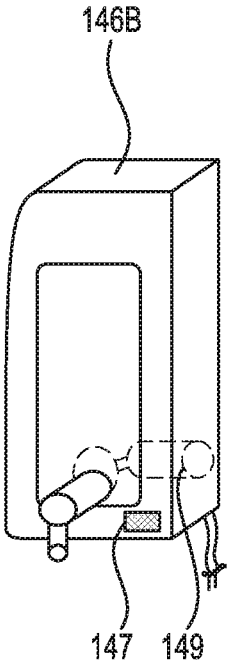
FIG. 13B is a detail view of a soap dispenser of an intelligent portable restroom according to certain example embodiments.

A soap dispenser 146 can be disposed nearby the hand wash station or incorporated into the station itself. A manual soap dispenser 146A is shown in FIG. 13A. An automatic soap dispenser 146B is shown in FIG. 13B. The automatic soap dispenser 146B dispenses soap when a sensor 147 senses the proximity of the user's hand. Both types of soap dispensers can include a level sensor 149 coupled to the processor for monitoring soap levels and need for replenishment. The soap dispenser 146 can be filled with any type of hand sanitizer, including soaps and alcohol-based sanitizers. Multiple dispensers can be provided to the restroom to provide the user with more than one type of sanitizer.

Referring now to FIG. 3, a portion of the inside of the restroom is shown. The touchless flush request sensor 121 is shown on the wall adjacent the commode 114. The sensor is actuated by the user waiving their hand in proximity to the sensor 121.

An emergency call button 148 is also located on the wall. This allows the user to call for assistance in case of an emergency, or if some assistance is needed. The call button is coupled to the processor, which reacts by initiating an assistance request. The processor can also establish a two-way voice conference with an operator to ascertain the nature of the assistance needed. A speaker/microphone assembly 150 is disposed along one of the walls to facilitate conversation with the operator.

The speaker assembly 150 can also be used to play music, announcements and/or advertising. A video screen 152 can also be disposed on a wall or inside of the door of the restroom. The video screen 152 can be a tablet computing device with a touch-responsive screen. The tablet 152 can be configured to allow the user to play music, view advertising, view announcements, hear messages, and interact with as a kiosk. The user of the restroom can also pair their personal mobile computing device (e.g. smart phone) via Bluetooth, or other wireless pairing means, in order to play music from their own computing device. The video screen or tablet 152 can be coupled to the processor and selectively powered up only when the processor determines that the restroom is in use.

One aspect of certain embodiments is a "flushing bowl". Rather than an opening into the waste tank below the toilet seat, a plastic bowl 154 is disposed above the waste tank just below the toilet seat as shown in FIG. 3. The bowl 154 blocks the user's view of the inside of the tank and provides for a flushing action to clean the waste from the bowl's inner surface.

Referring to FIGS. 3-5 and 11, the bowl 154 includes a relatively small opening 155 defined in a forward portion of the bowl body for water and waste to pass through into the tank. A spray nozzle 156 for directing water across the interior of the bowl is provided to the rear of the bowl's inner surface. The spray nozzle 156 creates a "flushing" spray to evacuate waste from the bowl. This flushing bowl design minimizes the amount of waste that the user can see if he looks into the toilet opening (i.e. waste hiding), making for a much more pleasant user experience.

In order to keep the toilet bowl inner surface cleaner longer, a light and steady flow of through the toilet bowl is created while the restroom is in use (e.g., the low pump setting referenced in FIG. 2). This prevents most waste from sticking and streaking the interior of the bowl. When a flush is requested, or initiated automatically, the flow of water is increased for a few seconds (high setting) in order to clear the bowl of any remaining waste.

Figure 6:
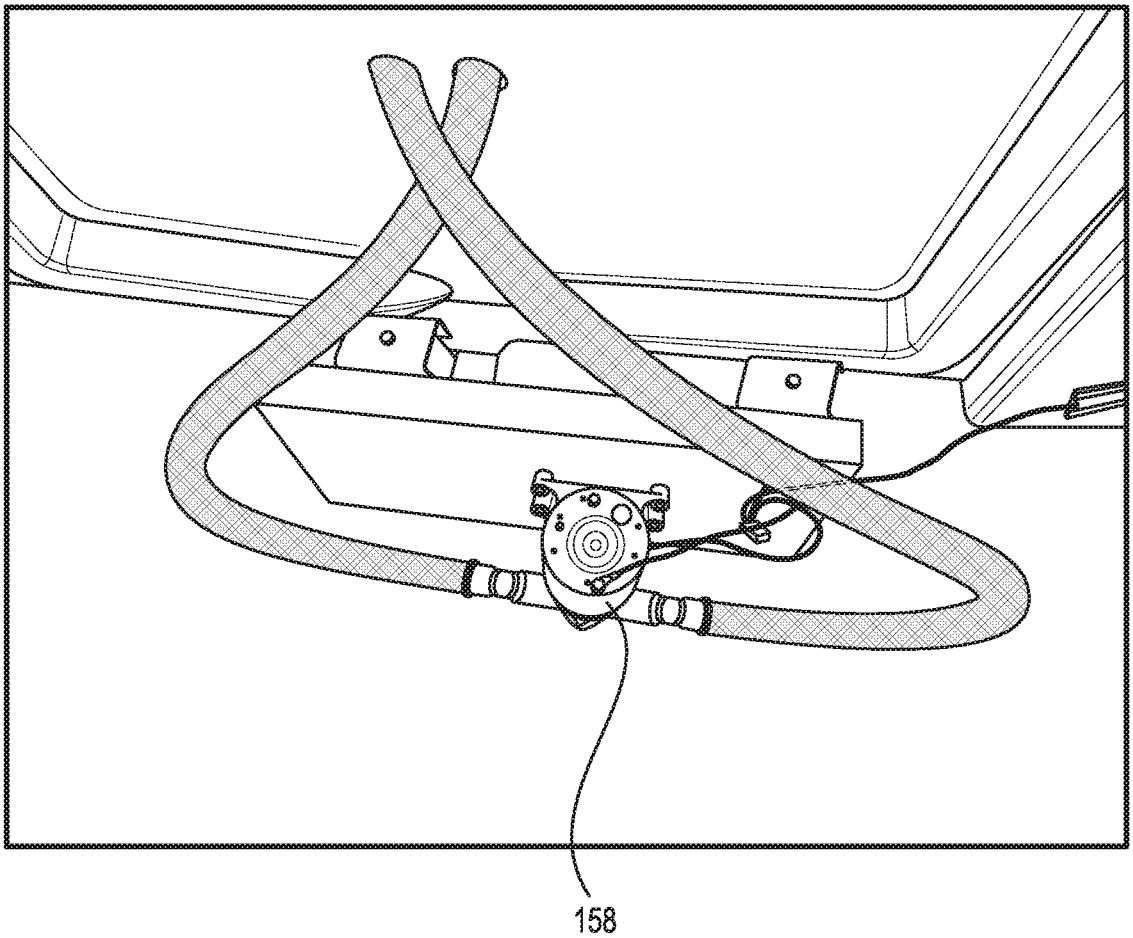
FIG. 6 is a detail view of a portion of an intelligent portable restroom according to certain example embodiments.

All flush water flow is provided by the electric pump 158, which can be located in the waste tank or in a fresh water flush tank 132. The electric pump 158 is shown in FIG. 6. The pump 158 is coupled to the fresh water flush tank 132 and the bowl's spray nozzle 156 via water conduits. The pump 158 is also coupled to the processor for controlling the pump speed and on/off settings.

Figure 7:
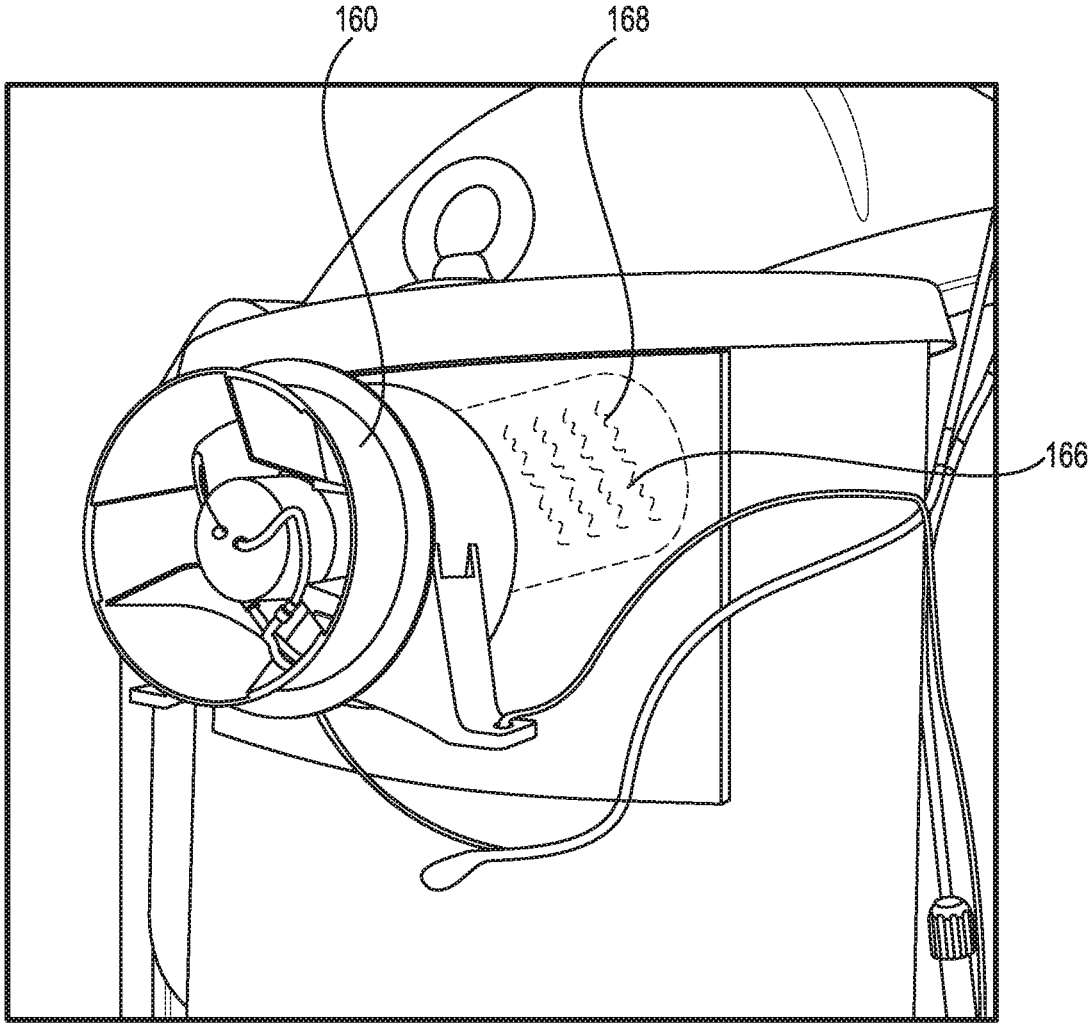
FIG. 7 is a detail view of a portion of an intelligent portable restroom according to certain example embodiments.

An electric fan 160 can be incorporated into a waste tank vent pipe 162 as shown in FIG. 7 as a further feature of certain embodiments. The fan 160 draws air from within the restroom, through the hole 155 defined in the front of the bowl 154, over the top of the waste, up through the vent pipe 162 (shown in FIG. 3), and exhausts out of the unit near the roof 104. This process draws fresh air into the unit through small vent holes 164 (shown in FIG. 19) located in the walls 102 of the restroom near its roof 104.

Alternatively, the fan 160 can be ducted into the interior of the restroom and a plurality of heating elements added 166 to the outlet 168. Outside air can be drawn into the fan housing and then warmed by the heating elements 166 as the fan exhausts into the restroom. A cooling unit can be provided in the same manner.

Figure 8:
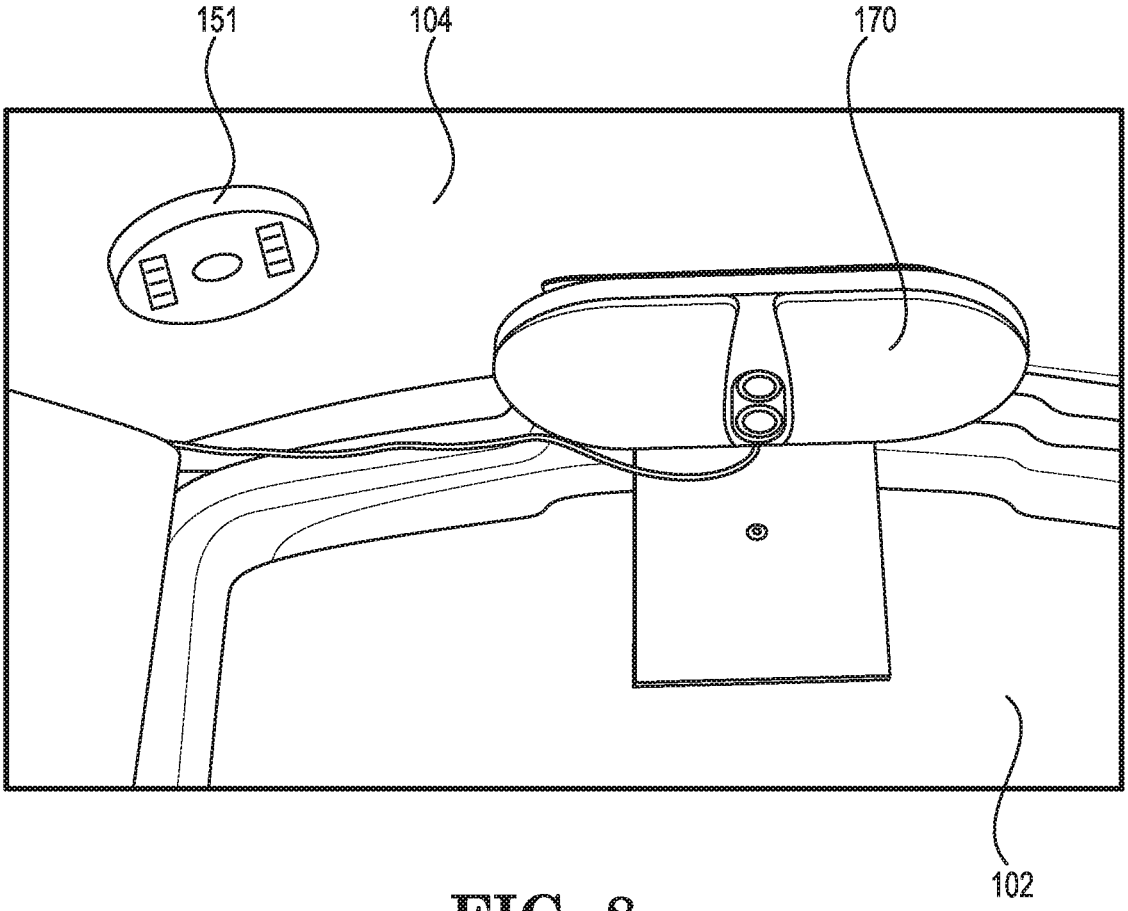
FIG. 8 is a detail view of a portion of an intelligent portable restroom according to certain example embodiments.

FIG. 8 shows a detailed view of an electric light 170 disposed in the interior of the restroom, near the roof, so the interior is lighted for ease of use and safety.

Figure 9:
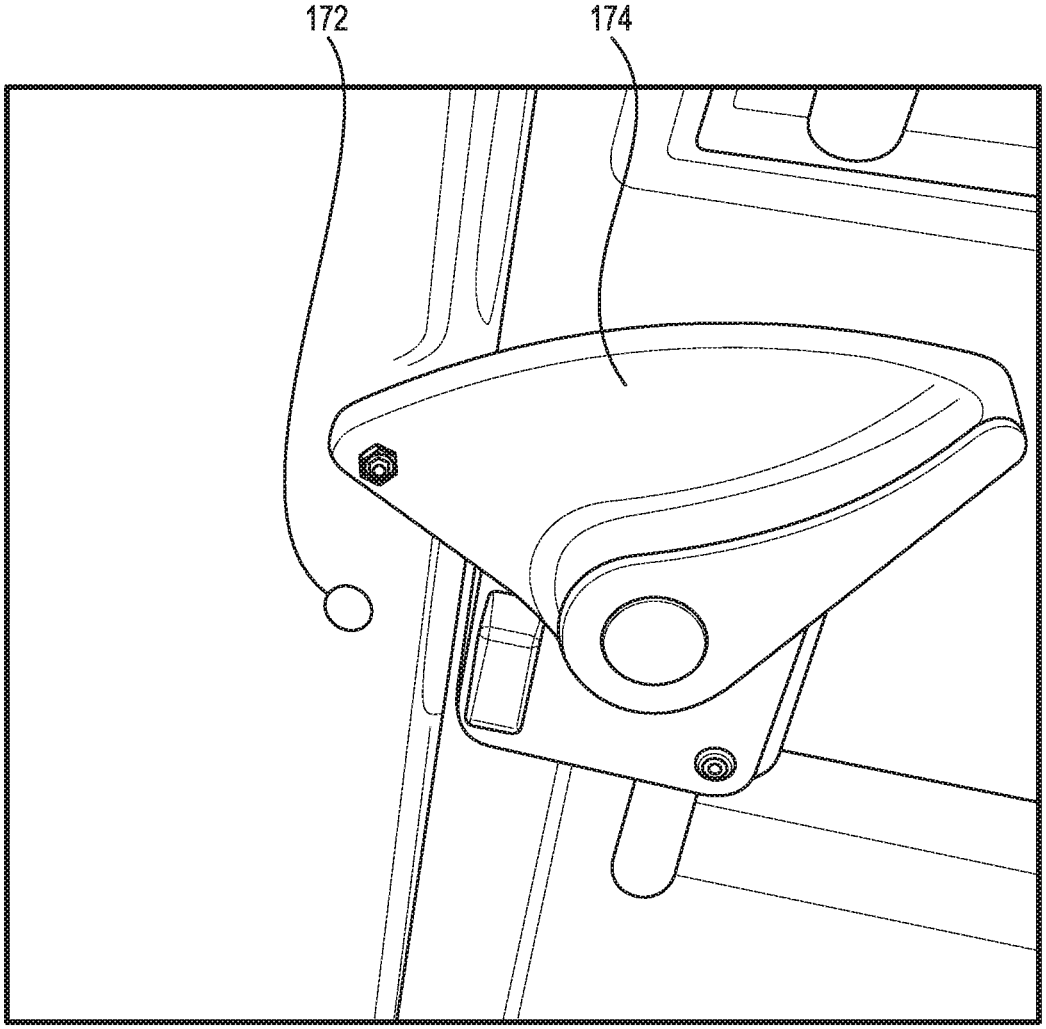
FIG. 9 is a detail view of a portion of an intelligent portable restroom according to certain example embodiments.

Referring to FIG. 9, a magnetic switch 172 (or other proximity sensor) is incorporated into the door frame. When the door lock 174 is moved to the closed position, the sensor will be triggered so that the processor can be informed of the lock state change.

Figure 10:
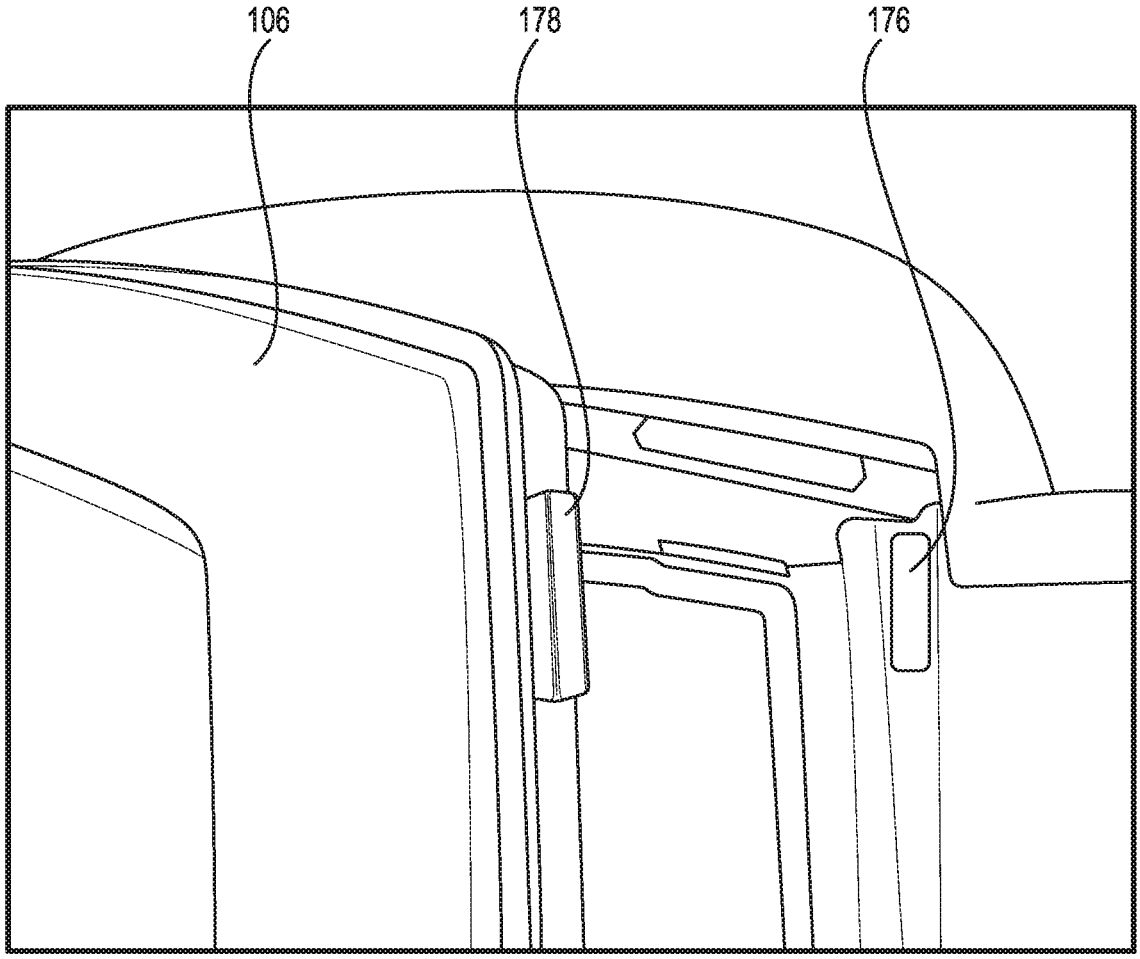
FIG. 10 is a detail view of a portion of an intelligent portable restroom according to certain example embodiments.
Figure 11:
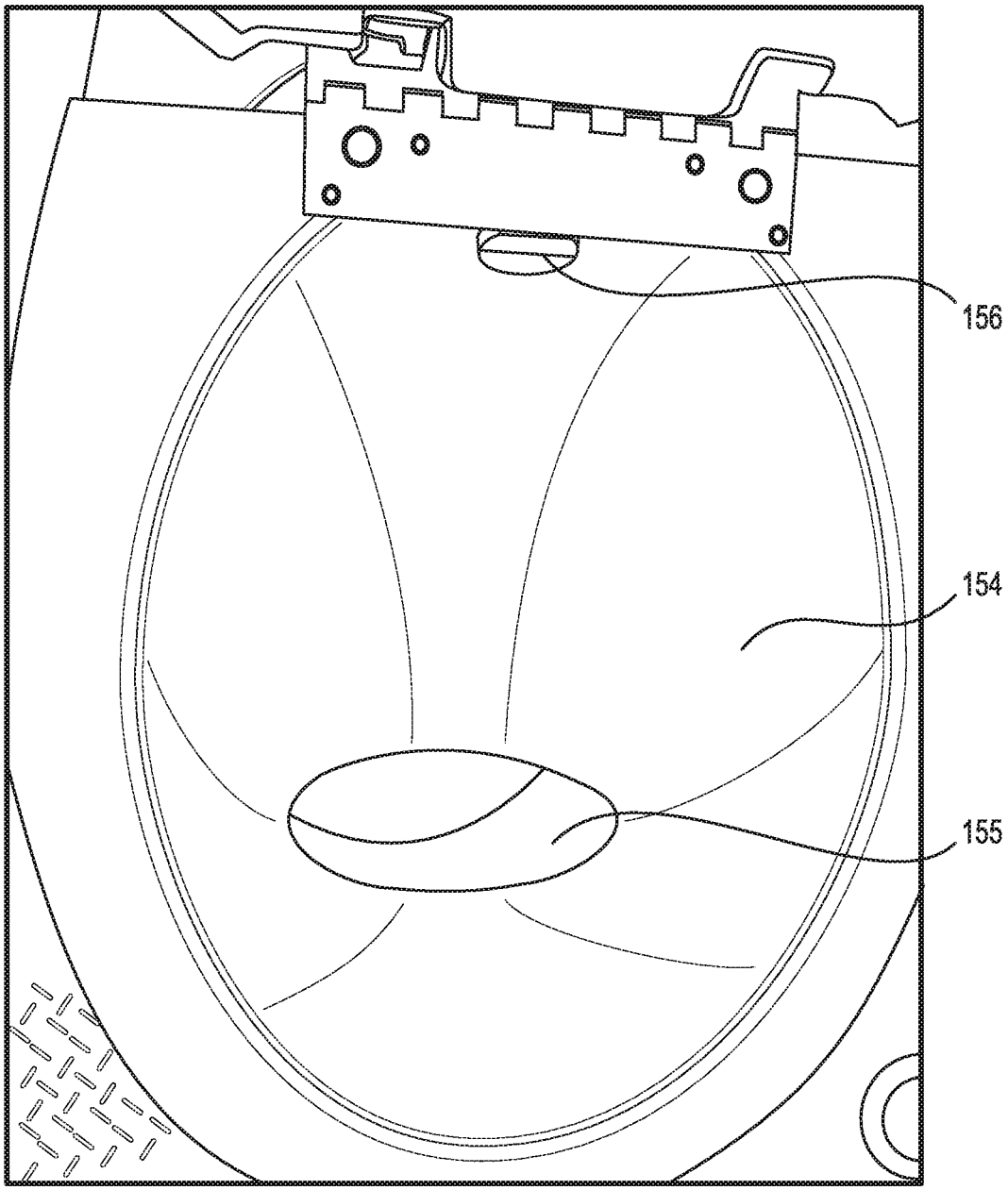
FIG. 11 is a detail view of a portion of an intelligent portable restroom according to certain example embodiments.

Similarly, as shown in FIG. 10, a magnetic switch 176 is disposed along the door frame so that a magnet 178 disposed along the edge of the door 106 informs the processor that the door has closed. A change of state can be monitored to determine whether the door is opened or closed.

In an effort to maximize interior space, a urinal is preferably not provided in the restroom. However, a separate urinal fixture can be provided without departing from the scope of the invention. The urinal is plumbed to empty into the waste tank. A flush nozzle can also be provided along the inside of the urinal to create a flushing action similar to the bowl as described herein. A sensor can be provided to the urinal and coupled to the processor to inform the processor when the urinal is being used instead of the commode 114.

Figure 4:
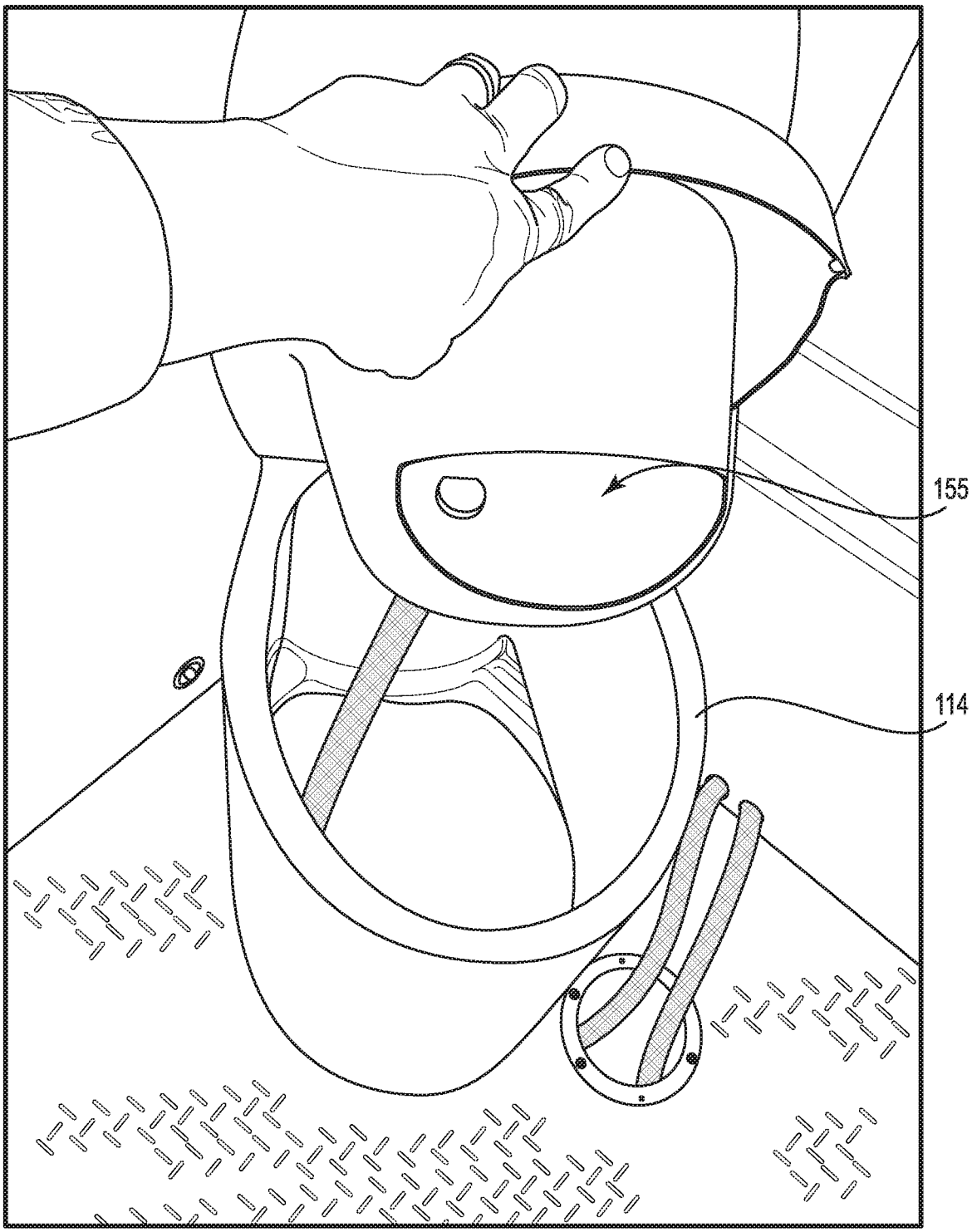
FIG. 4 is a detail view of a portion of an intelligent portable restroom according to certain example embodiments.
Figure 5:
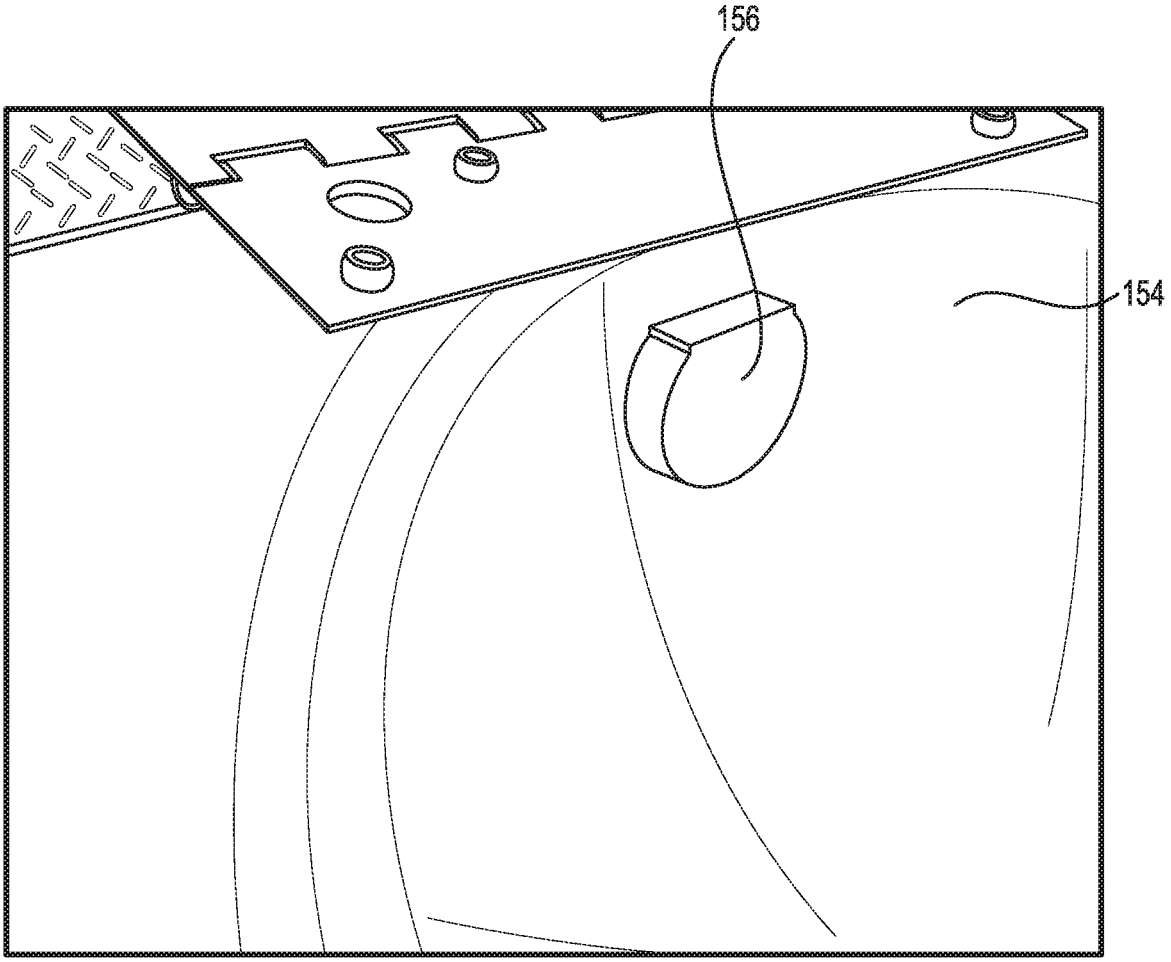
FIG. 5 is a detail view of a portion of an intelligent portable restroom according to certain example embodiments.

The waste tank can be pumped and charged through the commode opening, or through an access port 182 in the floor 112 (shown in FIG. 3). The flushing bowl 154 is hinged to allow it to pivot open, as shown in FIG. 4, to reveal and access the waste tank area below.

Figure 17:
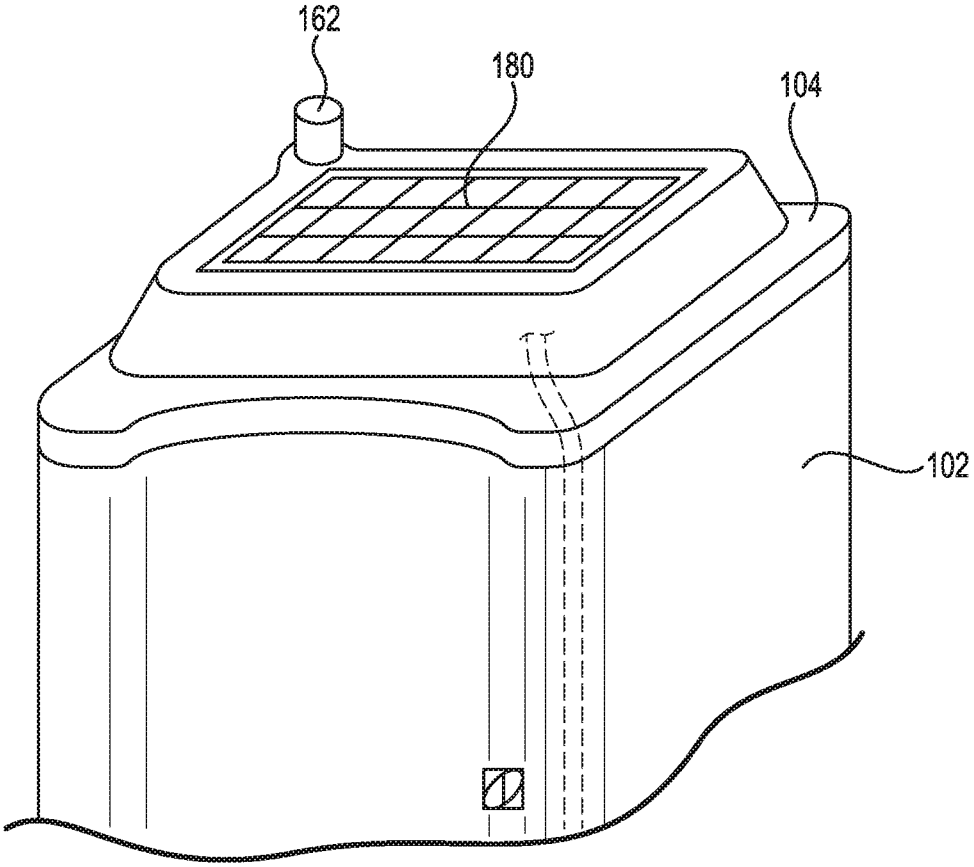
FIG. 17 is a partial exterior view of a solar powered portable restroom according to certain example embodiments.
Figure 18:
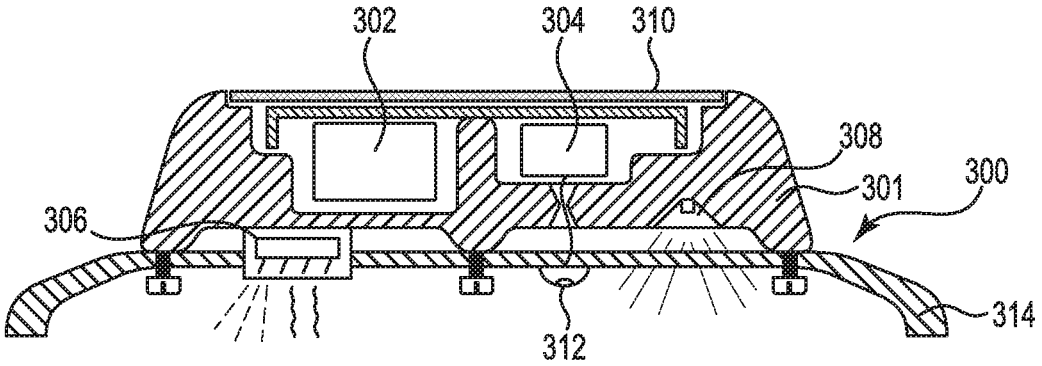
FIG. 18 is a partial cross sectional view of a solar powered portable restroom according to certain example embodiments.

Referring to FIG. 17, a solar panel 180 can be mounted on the roof 104 to supply power for charging the battery 116. An electronic charge controller 184 (indicated in FIG. 15) is provided as part of the electronics module, which is configured to convert the solar power to a voltage and current suitable for charging the battery, and for supplying 12 volt power for the control electronics and motors.

Figure 15:
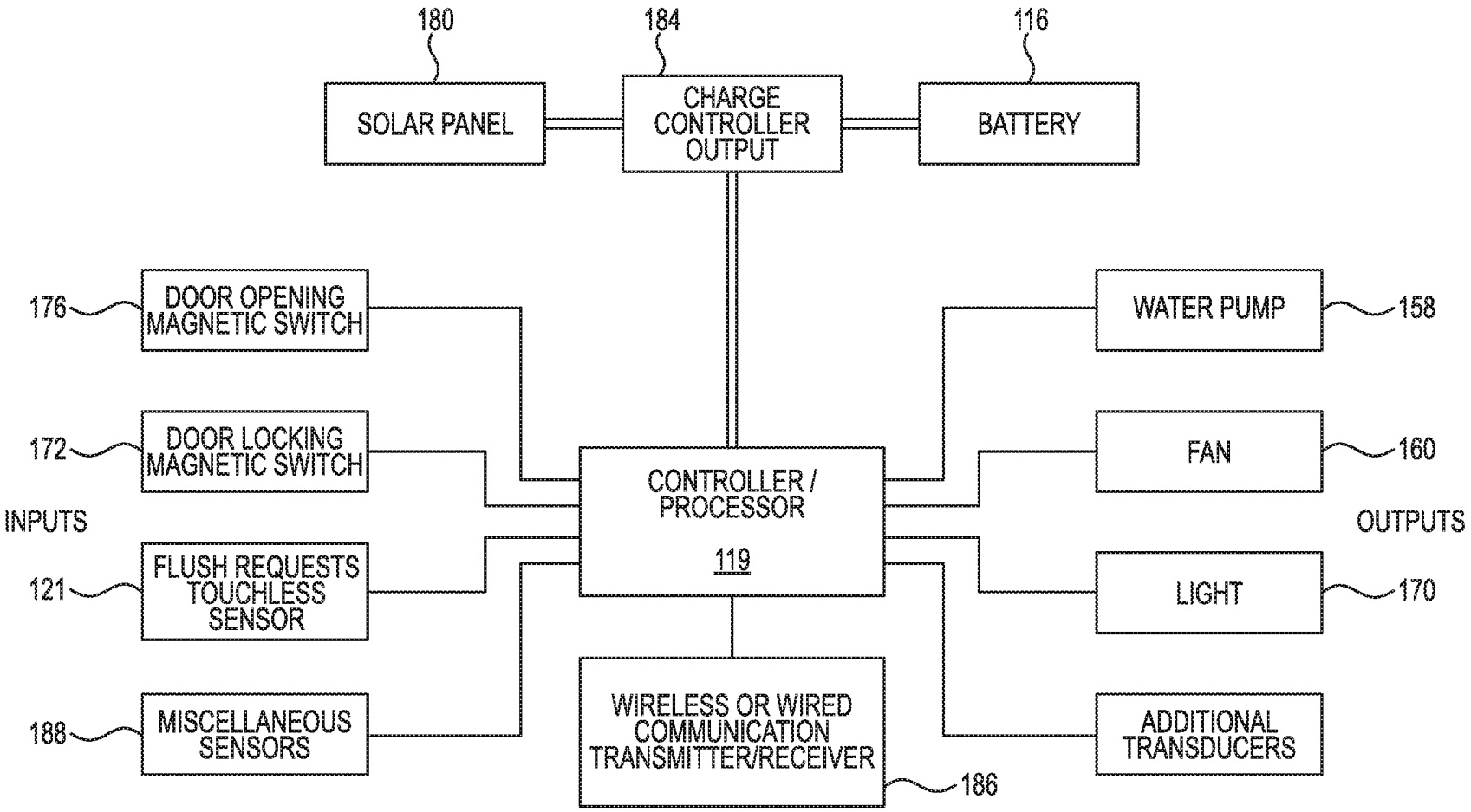
FIG. 15 is an electrical component diagram for an intelligent portable restroom according to certain example embodiments.

The control electronics 118 for the restroom are shown in greater detail in FIG. 14 alongside the battery 116. The electronics 118 include a processor 119 that controls all functions, logic, power modulation, and communications for the restroom 100. FIG. 15 shows diagrammatically how the processor is coupled to the various components and systems of the restroom.

One example of additional sensors noted in FIG. 15 can be a tilt sensor, a shock sensor or both. These sensors 188 are also indicated in FIG. 14. The tilt sensor monitors the deviation from horizontal so that the processor can monitor whether the restroom has been tipped over and send out an appropriate notification to the service operator. Likewise, a shock sensor informs the processor that the restroom has received an impact above a pre-set threshold. This could be that the restroom was struck by a vehicle or dropped from a height above the ground. Again, the service operator would be notified if the shock sensor is triggered.

The electronic controls also incorporate power monitoring and power saving programming. For example, if the battery charge falls below a preset threshold value, the processor will reduce the speed of the fan and/or eliminate the light flow of flush water during use, thereby saving battery power for the more important high powered flush and wireless communications.

A wireless communications module 186, such as Wi-Fi, Bluetooth or cellular is also included in the control electronics 118 and coupled to the processor 119 and a suitable antenna. The processor 119 is programmed to monitor usage of the restroom, such as number of full power flushes, number of door openings, or other measurable data, including passage of time. A combination of measured values can be monitored and evaluated by an algorithm to determine service interval. Data for all monitored inputs is stored in the memory coupled to the processor.

When the processor determines that service is required, a wireless signal is sent to the service operator (e.g., a restroom rental or leasing company) to inform the service operator that the restroom requires service. The signal can be in any form, including a text message, email, or an alert through a custom monitoring software interface executing on a dispatcher's or service person's computing device (including portable computing devices such as smart phones, tablets and vehicle navigation computers). The message sent by the processor can include the reason(s) for the service call and the data stored in memory.

The controller is further programmed to illuminate or provide a display to a potential user to use a different restroom if the controller has determined that its restroom is beyond acceptable power levels for proper function, or in need of service.

The controller can also send a service required notification or advise of a malfunction or other unexpected operating condition, including impending power failure. For example, the controller is programmed to alert the service operator if any of the incorporated sensors determine that service is needed. Functional properties which the controller can monitor include water level, waste level, battery charge, tilt of the restroom, GPS, shock, smoke, fire, temperature (excessive heat or freezing conditions which could harm components or occupants), time (elapsed time since last service), unit weight, weight, level or volume of waste, current sensors for the motors to determine if the motors are functioning properly, remaining toilet paper, remaining paper towels, remaining hand sanitizer, etc.

Figure 16:
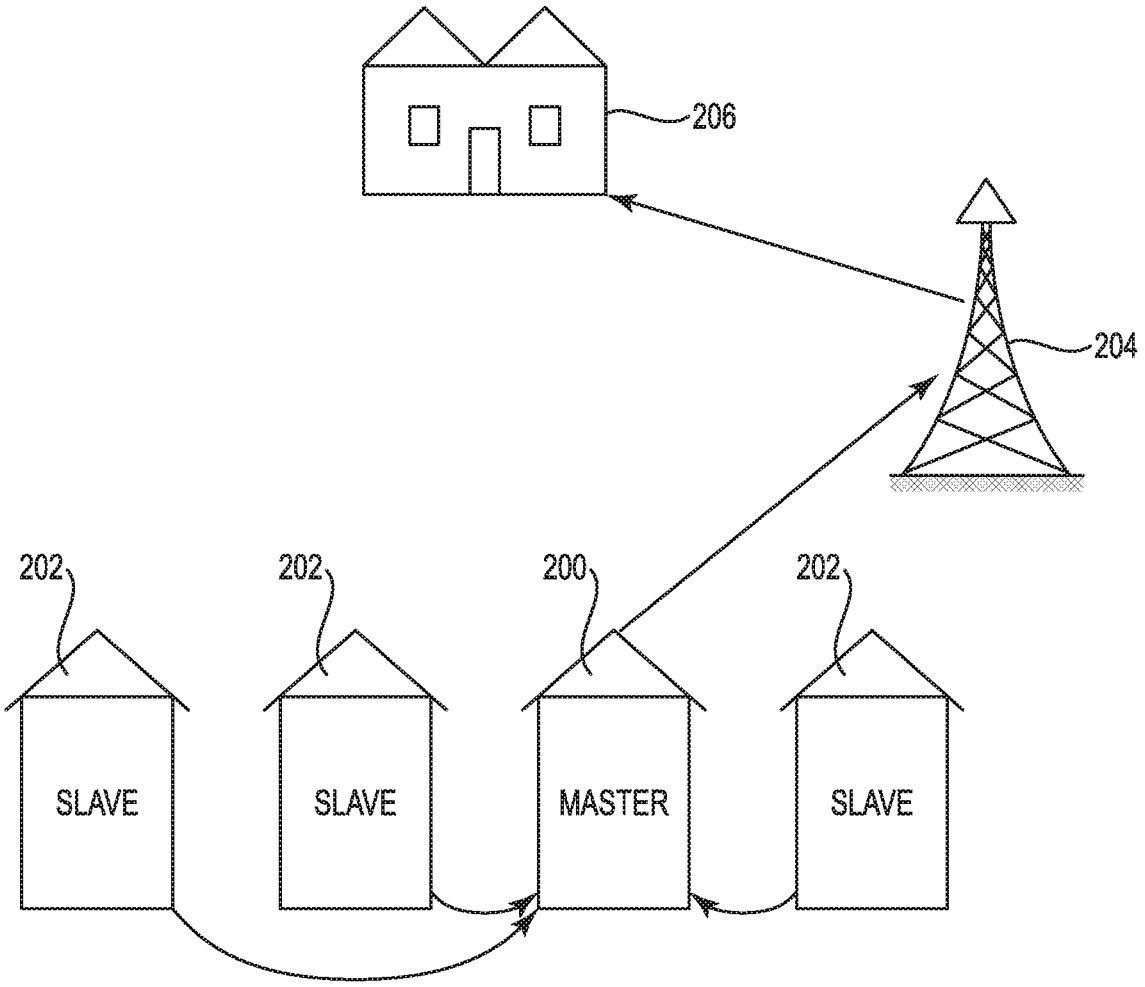
FIG. 16 is a diagram of portable restrooms with wireless communication capabilities according to certain example embodiments.

Referring to FIG. 16, in order to minimize the cost of the electronics in the restrooms, two variations of restroom can be provided, master 200 and slave 202. The master restroom 200 includes full communications capability, and potentially larger batteries and more processing power and memory. The slave 202 version would possess only short range communications capability (e.g. Bluetooth) and limited memory and controller capabilities.

An example master-slave installation at a site is shown in FIG. 16. A single master restroom 200 is adjacent to a plurality of slave restrooms 202. The master restroom 200 at the site includes the cellular communications electronics so that it can communicate wirelessly via cell networks 204 with the service operator 206. All the slave restrooms 202 at the site only have a less expensive method of communication such as Wi-Fi or Bluetooth that communicates only with the master. Each slave restroom 202 can communicate wirelessly with its neighboring restrooms as part of a communications chain in order to pass along or collate data from all restrooms at the site. The master then collects the data from all the site's restrooms and issues the service calls (or sends outbound signals to the service computer) as needed to communicate the needs of all the restrooms at the site.

Each slave restroom 202 can be programmed to report its respective usage data to the master restroom, where the data will be stored in memory and monitored for service needs.

The "slave" restrooms 202 alternatively can be coupled to each other and to the master 200 via physical cables or conduits such as an Ethernet wire. Thus, the cost of the wireless transmission electronics in the slave restrooms can be eliminated.

While the service operator is on site, in close proximity to a given restroom, that restroom's processor is programmed to communicate wirelessly (e.g. via Bluetooth or radio frequency) with an electronic device carried by the service operator (e.g. smart phone or other portable computing device) and upload collected data along with restroom status to the service operator's portable computing device.

Once a restroom has been serviced and previous data has been downloaded, the processor memory can be "reset" to begin logging new data. All logged data can also be "phoned in" to the service provider via a cell network or other wireless network. The processor can also have its software code wirelessly updated via the service operator's electronic device or via the cellular network.

There are numerous benefits of the respective aspects of certain embodiments of the invention. For example, the automatic flushing of the toilet upon exit of the user provides a more pleasant experience for the next user, and promotes hygiene. The touchless flushing feature eliminates the spread of germs from a manual flush lever. The automatic fan evacuates odors and harmful vapors from the restroom as the user enters, evacuates stagnant hot air, and provides continued ventilation during use.

The combination of sensors, processor and wireless communication allows the restroom to self-monitor and notify the service operator of the need for service should it arise before the pre-scheduled service interval. This reduces the chance of a user having a bad experience while using the portable restroom.

The control electronics can further include a GPS decoder component. Thus, a GPS locating feature can be provided to help the service operator find a given restroom for servicing, find a specific restroom within a crowd of units, and help locate a stolen restroom. This GPS feature can be integrated into digital map software on the operator's electronic device to provide directions for driving, service route planning, and asset utilization optimization.

A pay-per-use system can also be enabled by the processor and an automatic locking mechanism coupled to the restroom's door. The processor can be programmed to communicate with the user's smart phone or other personal electronic device and perform a contactless electronic financial transaction using conventional contactless payment means. A credit card terminal 192 can also be disposed on an outer wall as shown in FIG. 19. A currency acceptance module can also be provided. The service operator or event organizer could offset their cost of the restroom rental by charging a fee for use of the restroom. The wireless communication capability of the restroom facilitates interfacing with various payment facilitators (e.g., a credit card company).

The controller can communicate the need for service (or emergency situation) to a service operator, to a representative for the event where the restroom is being used, to a service truck driver, to the local police or fire department, to a 911 operator, to an on-site cleaning service, etc. The emergency call switch 148 can be provided within the restroom and coupled to the processor to enable a user to request emergency assistance.

Upon delivery of the restroom to the installation site, the service operator can change the phone number(s) or email address(es) that the controller contacts as the situation dictates.

The data monitored and logged by the restroom can include the number of uses, frequency of use, time of each use, length of each use, number of flushes, level of waste in the tank, temperature at points in the day, battery charge level, level of fresh water, charging parameters throughout the day, date and time of last service, etc. This data could be retrieved by the service provider via wireless communication, or Bluetooth communication directly to a mobile computing device.

Referring again to FIG. 19, the restroom can include an exterior light 190 for ease of use as well as safety at night. The exterior light can include a proximity sensor so that the light is illuminated only when a person is close to the door, either for entering or exiting the restroom.

Sensors can be incorporated into the housing to detect malfunction of the water pump(s), light and fan.

A smoke or fire sensor 151 can be disposed on a wall or along the ceiling of the restroom, as shown in FIG. 8, and coupled to the processor. The processor monitors the fire sensor and can alert the service operator and/or fire department. The fire sensor can be a fire/smoke alarm that includes audible and visual warnings that are issued when smoke or fire are detected.

A security camera 153 can also be disposed inside of, or external to, the restroom. The camera 153 can be triggered by the processor to record upon the trigger of certain events, including for example, tipping, impact, movement, heat, smoke, fire, emergency call, etc.

An audio alarm or recorded message can be stored in memory and played through the speaker 150 if the restroom is sensed as being vandalized or mistreated.

A prerecorded audio or video message can be stored in memory and be played to the user. The audio message can be information about the restroom, the event, daily news, music, weather, community alert messages, advertising, etc. The service provider can wirelessly communicate with the restroom's controller to "push" the message data at a predetermined interval or on an as needed basis.

Wi-Fi access for the user (or nearby persons) can be provided, or sold on a pay-per-use basis.

While the restroom preferably communicates wirelessly, the same information can alternatively be communicated over physical transmission wires, although this method is best suited for a permanent or long-term restroom installation, or in an environment containing radio interference.

The electrical power for the intelligent restroom may come from solar-charging, wind generation, an electrical cord plugged in to nearby facilities, a portable gas generator, a chemical reaction cell such as a hydrogen fuel cell, etc. It could also be provided by a battery that is charged, or replaced, by the service operator during a service call.

The restroom electronics and motors are configured to run on 12 volt DC power due to its prevalence in automotive and RV products and safety in wet environments, but any voltage or type of current could be used. For example, 110 volts AC, or 240 volts three-phase AC. Any type of battery may be used—nickel metal hydride, lead acid, gel, dry cell, lithium ion, etc.

The restroom is formed primarily of plastic materials, such as polyethylene, for their durability and resistance to corrosion and low price, however any material could be used, such as steel, stainless steel, wood, wood composites, bamboo, etc. All types of manufacturing processes could be used as well.

The intelligent restroom can contain any, all, or a mix of the sensors and capabilities disclosed herein. Additional sensors and communication capabilities can be provided as well.

The restroom can be disposed on a plastic base, and be movable by a single person. Depending on materials used, the restroom can weigh enough to require several people or a forklift to move. The restroom can also be mounted on wheels, or have detachable or retractable wheels.

The magnetic switches 172, 176 used to detect when the door is opened or locked provide a very reliable method for determining when the unit is occupied. However other devices and sensing methods can be used for determining occupancy without departing from the scope of the invention, including: infrared sensors, ultrasonic sensors, microwave sensors, laser sensors, pressure switches, non-magnetic switches, optical beam sensors, capacitance sensors, inductance sensors, temperature sensors, etc.

The various electrical components discussed herein can be incorporated into the construction of the walls, roof and floor of the portable restroom, or they can be housed in a separate, detachable structure mounted on the exterior roof of the restroom as will be discussed below.

Mounting the various components inside the restroom may require portions of the structure of the restroom to be designed specifically for the sensors and systems. However, in an additional embodiment, a detachable retrofit structure 300, such as that shown in FIG. 18 allows certain intelligent systems to be retrofitted onto almost any restroom roof, thereby bringing many of the aforementioned comfort features to any existing portable restroom. This detachable structure 300, or "solar pod", comprises a formed plastic housing 301 in which the battery 302, electronic controls 304, fan 306, light 308, and solar panel 310 are disposed. An occupancy sensor 312 (e.g. optical, infrared, etc.) is coupled to the control electronics to determine whether a person is occupying the inside of the restroom.

With the solar pod mounted on the roof of the restroom, wires can also be run down the walls of the restroom to the ancillary electrical components: switches to detect door opened and locked, flush request sensor, electric pump located in the waste tank, and any other additional sensors needed for operation of the included features. The structure of the underside of the solar pod is configured to mate with a specific restroom roof, or it could be designed to mate with a roof adaptor 314 to adapt to multiple different roof designs.

Because the roof of most portable restrooms is a translucent white plastic, the light source 308 for lighting the restroom interior could be installed on the underside of the solar pod 300 and simply illuminate through the roof. This eliminates the need to install a separate light fixture inside the restroom, along with its associated wiring. It would also make it very difficult for a vandal to break the light.

The solar pod 300 can mate with the existing restroom vent pipe 162, protruding from the roof, and contain passages to direct the air flow from the vent pipe through the electric ventilation fan in the solar pod and then out to the atmosphere. This eliminates the need to mount the fan inside the restroom, along with its associated wiring.

Mounting the battery inside the solar pod 300 eliminates the need to locate it near or under the floor of the restroom, where it can take space away from the restroom interior or from the waste tank volume—both detrimental to restroom comfort and function. The solar pod 300 also allows the majority of the wiring and system components to be well protected from curious users and vandals.

Other features and aspects of the invention can be appreciated from the depictions in the figures, even if not described in writing herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A portable restroom, comprising:

a door for accessing an enclosed interior of the portable restroom;

a waste tank;

a commode disposed within the enclosed interior and coupled to the waste tank;

a power source;

a microprocessor coupled to the power source;

a door sensor positioned to sense whether the door is open or closed, the door sensor coupled to the microprocessor; and a door lock sensor positioned to sense whether the door is locked or unlocked, the door lock sensor coupled to the microprocessor.

2. The portable restroom of claim 1, further comprising:

a fresh water tank;

an electric pump coupled to the microprocessor and operably coupled to the fresh water tank and to the commode; and a fresh water level sensor disposed in the fresh water tank and coupled to the microprocessor.

3. The portable restroom of claim 1, wherein the commode comprises a bowl, the bowl defining an opening in a front portion thereof, and a water spray nozzle disposed on a rear portion of the commode.

4. The portable restroom of claim 1, further comprising a hand wash station disposed within the enclosed interior and coupled to a fresh hand wash water tank, wherein a hand wash level sensor is disposed within the fresh hand wash water tank and coupled to the microprocessor.

5. The portable restroom of claim 4, further comprising a heating element disposed within the fresh hand wash water tank.

6. The portable restroom of claim 1, further comprising a payment receiving means provided to the portable restroom and coupled to the microprocessor so that a user can provide payment for access to the portable restroom.

7. The portable restroom of claim 1, further comprising a hand dryer disposed within the enclosed interior and coupled to the power source.

8. The portable restroom of claim 1, further comprising an electronic paper hand towel dispenser disposed within the enclosed interior and coupled to the power source.

9. The portable restroom of claim 1, further comprising a waste tank heater disposed within the waste tank and coupled to the microprocessor.

10. The portable restroom of claim 1, further comprising a wireless communications module coupled to the microprocessor, wherein the processor is configured to submit a service call automatically via the wireless communications module upon the microprocessor determining from the waste level sensor that a waste level in the waste tank has reached a set threshold.

11. The portable restroom of claim 1, further comprising a touchless flush request sensor disposed within the enclosed interior and coupled to the microprocessor.

12. The portable restroom of claim 1, wherein the micro processor is configured to actuate a pump to pump a continuous stream of water through a bowl of the commode upon determining by the microprocessor that the door has been opened and then locked within a set time window.

13. The portable restroom of claim 1, further comprising:

an emergency call button provided to the enclosed interior of the portable restroom and coupled to the microprocessor; and a wireless communications module disposed coupled to the microprocessor, wherein the microprocessor is configured to relay a request for assistance to an emergency services operator upon a user actuating the emergency call button.

14. The portable restroom of claim 13, further comprising a microphone and speaker provided to the enclosed interior of the portable restroom and coupled to the microprocessor, wherein the microprocessor is further configured to establish a two-way voice communication between the emergency services operator and the user upon the user actuating the emergency call button.

15. A portable restroom, comprising:

a door for accessing an enclosed interior of the portable restroom;

a waste tank;

a commode disposed within the enclosed interior and coupled to the waste tank;

a power source;

a microprocessor coupled to the power source;

a door lock positioned to automatically lock and unlock the door, the door lock coupled to the microprocessor; and a payment receiving means provided to the portable restroom and coupled to the microprocessor so that a user can provide payment for access to the portable restroom.

16. A portable restroom, comprising:

a door for accessing an enclosed interior of the portable restroom;

a waste tank;

a commode disposed within the enclosed interior and coupled to the waste tank;

a power source;

a microprocessor provided to the portable restroom and coupled to the power source; and an interactive video screen provided to the enclosed interior of the portable restroom.

17. The portable restroom of claim 16, further comprising a payment receiving means provided to the portable restroom and coupled to the microprocessor so that a user can provide payment for access to the portable restroom.

18. The portable restroom of claim 15, further comprising:

a wireless communications module coupled to the microprocessor; and a waste level sensor provided to the waste tank and coupled to the microprocessor, wherein the processor is configured to submit a service call automatically via the wireless communications module upon the microprocessor determining from the waste level sensor that a waste level in the waste tank has reached a set threshold.

19. The portable restroom of claim 18, further comprising a wireless communications module coupled to the microprocessor so that an electronic payment by the user can be processed by a financial institution.

20. The portable restroom of claim 18, wherein the microprocessor is programmed to communicate with a smart phone or other personal electronic device of the user and perform a contactless electronic financial transaction to allow the user to access the portable restroom.

* * * * *